US008479677B2

(12) United States Patent
Bolline et al.

(10) Patent No.: US 8,479,677 B2
(45) Date of Patent: Jul. 9, 2013

(54) LIFT MECHANISM FOR LIFTING A SWIM PLATFORM ABOVE AND OVER A REAR DECK OF A BOAT

(75) Inventors: Robert Bolline, St. Petersburg, FL (US); Nicholas Asseff, Clearwater, FL (US); Sunthorn Ingersoll, Tampa, FL (US)

(73) Assignee: Nautical Structures Industries, Inc., Largo, FL (US)

( * ) Notice: Subject to any disclaimer, the term of this patent is extended or adjusted under 35 U.S.C. 154(b) by 0 days.

(21) Appl. No.: 13/282,088

(22) Filed: Oct. 26, 2011

(65) Prior Publication Data

US 2013/0104794 A1 May 2, 2013

(51) Int. Cl.
*B63B 17/00* (2006.01)

(52) U.S. Cl.
USPC ..... 114/362

(58) Field of Classification Search
USPC ..... 114/362, 365, 366, 284, 259, 368, 114/369, 44, 373
See application file for complete search history.

(56) References Cited

U.S. PATENT DOCUMENTS

| | | | | |
|---|---|---|---|---|
| 582,069 | A * | 5/1897 | Leslie | 114/373 |
| 1,587,979 | A * | 6/1926 | Nelson | 114/366 |
| 6,327,992 | B1 * | 12/2001 | Martin | 114/259 |
| 6,474,256 | B1 * | 11/2002 | Vogel | 114/368 |
| 6,598,549 | B1 * | 7/2003 | Voegeli | 114/44 |
| 6,782,842 | B1 * | 8/2004 | Alvord | 114/369 |
| 6,786,170 | B2 * | 9/2004 | Trowbridge | 114/259 |
| 7,293,521 | B1 * | 11/2007 | Johns et al. | 114/259 |
| 7,377,720 | B2 * | 5/2008 | Stewart | 405/3 |
| 7,707,955 | B1 * | 5/2010 | Johns et al. | 114/259 |
| 7,735,441 | B2 * | 6/2010 | Borum et al. | 114/259 |
| 7,866,275 | B2 * | 1/2011 | Schmidt, Jr. | 114/362 |
| 7,946,243 | B1 * | 5/2011 | Ulrich | 114/362 |
| 8,061,932 | B1 * | 11/2011 | Latham | 405/3 |
| 8,286,574 | B2 * | 10/2012 | Muller | 114/362 |
| 2003/0192466 | A1 * | 10/2003 | Trowbridge | 114/366 |
| 2008/0105186 | A1 * | 5/2008 | Johns et al. | 114/259 |
| 2010/0212576 | A1 * | 8/2010 | Muller | 114/362 |
| 2011/0017119 | A1 * | 1/2011 | Muller | 114/284 |
| 2011/0017122 | A1 * | 1/2011 | Muller | 114/362 |
| 2011/0023770 | A1 * | 2/2011 | Brown | 114/362 |

* cited by examiner

*Primary Examiner* — Lars A Olson
*Assistant Examiner* — Jovon Hayes
(74) *Attorney, Agent, or Firm* — Larson & Larson, P.A.; Frank Liebenow; Justin P. Miller

(57) ABSTRACT

A swim platform lift mechanism is disclosed, the mechanism mounted between the transom of a boat and a bottom surface of a swim platform. The lift mechanism provides a powered lifting/lowering of the swim platform from a retracted position that is level with the deck of the boat to a deployed position in which the swim platform is below the surface of the water surrounding the boat and from the retracted position to an up-and-over position in which the swim platform and its contents are positioned above and forward of the rear edge of the deck. The up-and-over position provides for an improved center of gravity when transporting a dingy on the swim platform.

9 Claims, 9 Drawing Sheets

LIFT MECHANISM FOR LIFTING A SWIM PLATFORM ABOVE AND OVER A REAR DECK OF A BOAT

FIELD

This invention relates to boats and more particularly to a lift mechanism for lifting a swim platform of a boat above the rear deck surface of the boat.

BACKGROUND

Some boats have what is known as a swim platform extending outwardly from the rear of the boat (stern). For many uses, the swim platform is stationary and provides added space and safety features. The added space is very useful when swimming from the back of the boat, providing a clear area for the swimmer to board the boat when finished swimming. For inboard/outboard boats, the swim platform provides additional safety by extending outward, over the propeller and the outdrive. This helps keep swimmers and divers away from the features, such as propellers, that sometimes come into contact with the swimmer/diver, causing injuries.

Another popular use for the swim platform is for transportation of a personal watercraft such as a dingy. For some light weight personal watercraft, such as canoes and kayaks, it is relatively easy for the user to slide the personal watercraft off the swim platform into the water and, somewhat easy for the user to get the personal watercraft back onto the swim platform after use. This is not the case for a heavier personal watercraft such as a jet ski, an inflatable boat with an outboard engine, a larger dingy for a yacht, etc. With such heavier watercraft, it is difficult or impossible for a user to manually deploy such watercraft and even harder to lift these heavy watercraft back onto the swim platform.

There are several known solutions for deploying such heavy watercraft. The first, often used on larger boats or yachts, is the use of a crane. The crane is used to lift the watercraft then swing the watercraft around for placement into the water adjacent to the boat. When finished with the watercraft, the crane is used to lift the watercraft for replacing it onto the swim platform of the boat. Cranes are well known and are useful for swim platform storage as well as storage of the personal watercraft at other locations on the boat.

Another solution for deploying the watercraft is to mechanically lower and lift the swim platform. The swim platform is lowered below the water surface so that the personal watercraft floats and is easily moved away from the boat. Likewise, to return the watercraft to the swim platform, the swim platform is again lowered beneath the surface of the water, the watercraft is positioned over the submerged swim platform, and then the swim platform is raised to a position where it is level with a deck of the boat. Such mechanical systems are usually hydraulic lift systems.

There are several problems with prior swim platforms that have mechanical systems to lower the watercraft (dingy, jet ski, etc.) into the water. First, the weight of the mechanical systems for lowering, the weight of the swim platform itself, and the weight of the watercraft greatly affect the center of gravity of the boat. This additional weight is especially disadvantageous for many boats that must get up "on plane" during cruising speeds, requiring more fuel and time to get on plane, and increasing the speed required to remain on plane. This results in a vast reduction in fuel economy.

Many prior swim platforms are fixed in place and well supported by the transom of the boat. The brackets that hold such swim platforms in place provide a very sturdy platform that does not bend when one steps onto the platform. It is very disconcerting for a boater to step on a swim platform that bends or oscillates up and down. Swim platforms that have mechanical systems to lower the watercraft often do not have this stiff, sturdy feel. When one steps onto a mechanically lowered/raised swim platform of the prior art, the swim platform bends or bounces, yielding an uneasy feeling. This is often due to the mechanical design of the system. Most conventional lifts leave their arms in a position where they perform as bending beams and are therefore susceptible to noticeable deflection.

What is needed is a mechanism that will raise the swim platform above the deck of the boat and forward towards the bow of the boat to reduce the possibility of drag and improve the planing characteristics of the boat.

SUMMARY OF THE INVENTION

The swim platform lift mechanism mounts between the transom of a boat and a bottom surface of a swim platform, providing for lifting/lowering of the swim platform from a retracted position that is level with the deck of the boat to a deployed position where the swim platform is below the surface of the water surrounding the boat. In the deployed position, easy deployment of a dingy or other watercraft that is stored on the swim platform is made possible. The swim platform lift mechanism has a second lift mechanism that further lifts the swim platform to a position that is above the rear deck of the boat and forward, thereby improving the center of gravity of the boat when a dingy is carried on the swim platform and, thereby, improving the ability of the boat to come up on plane.

In one embodiment, a platform lifting mechanism for a boat is disclosed. The lifting mechanism has a mechanism for raising and lowering the platform of the boat to/from a first position that is level with a deck of the boat to/from a second position that is at least lower than the deck of the boat and a second mechanism for raising and lowering the platform to/from the first position to/from a third position that is above the deck of the boat, wherein when in the third position, the platform at least partially overlaps the deck of the boat.

In another embodiment, a swim platform lifting mechanism for a boat is disclosed. The boat is floating in a liquid. The lifting mechanism includes a mechanism for raising and lowering a swim platform of the boat to/from a first position that is level with a rear deck of the boat to/from a second position that is at least below a surface of the liquid in which the boat is floating. An up-and-over mechanism raises and lowers the swim platform to/from the first position to/from a third position that is above the rear deck of the boat and wherein the swim platform is closer to a bow of the boat than when in the first position. The up-and-over mechanism includes a lower frame. The lower frame is coupled to the mechanism for raising and lowering a swim platform to/from a first position to/from a second position. The up-and-over mechanism also has an upper frame. The upper frame is coupled to a bottom surface of the swim platform. At least two arms couple the upper frame to the lower frame. A first end of each arm is rotatably coupled to the lower frame and a distal second end of each arm is rotatably coupled to the upper frame. At least one hydraulic ram provides the lifting action. A first end of the hydraulic ram(s) is connected to the upper frame and a second end of the hydraulic ram(s) is connected to the lower frame or arms such when the hydraulic ram is compressed, the swim platform is level with the rear deck and as the hydraulic arm is pressurized (expanded), the upper frame raises upwardly by an arc movement of the arms such that a forward edge of the swim platform raises above a rearward edge of the rear deck of the boat before the swim platform continues to move upward and towards the bow of the boat. With this movement, the forward edge of the swim platform clears the rearward edge of the rear deck before the swim platform moves towards the bow of the boat.

In another embodiment, a method of lifting a swim platform for a boat is disclosed. The boat is floating in a liquid. The method includes lowering the swim platform using a deployment lift system that is affixed to a transom of the boat until the swim platform is below a surface of the liquid then positioning a water craft upon the swim platform. Next, the swim platform is lifted using the deployment lift system until the swim platform is substantially level with a deck of the boat. Continuing, the swim platform if further lifted using an up-an-over hydraulic lift system that is interfaced between the deployment lift system and the swim platform. The up-an-over hydraulic lift system lifts the swim platform in an upward direction until at least a forward edge of the swim platform clears a rear edge of the deck of the boat, then the up-an-over hydraulic lift system lifts the swim platform further in the upward direction while the up-an-over hydraulic lift system also moves the swim platform in a forward direction so that the swim platform overlaps a rear deck of the boat.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
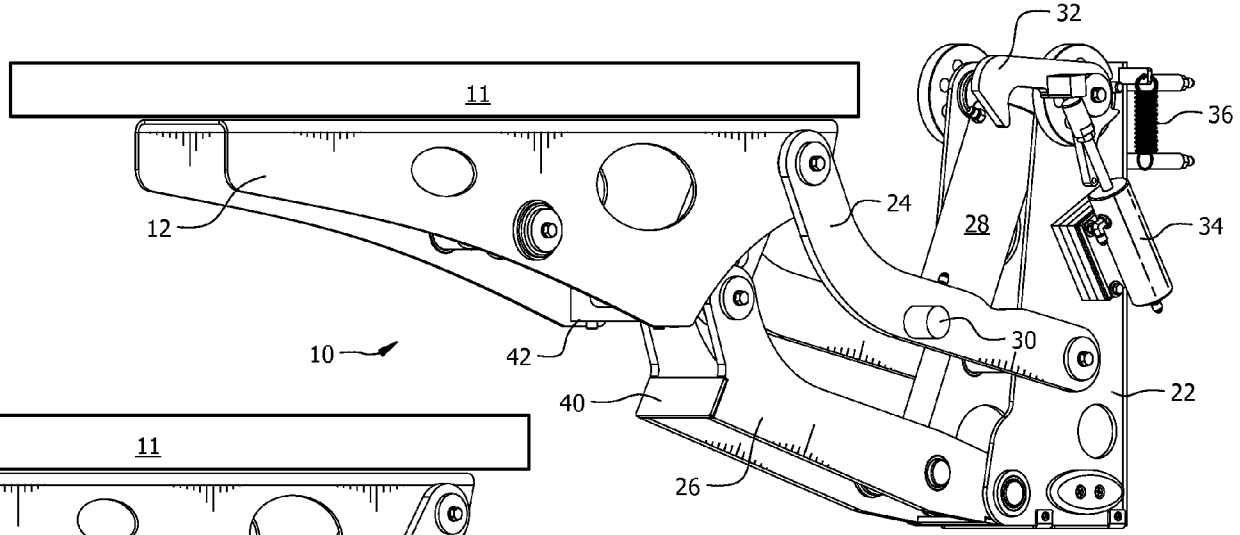
FIG. 1 illustrates a swim platform and mechanism for deploying a watercraft that is held by the swim platform in a lowered position.

Reference will now be made in detail to the presently preferred embodiments of the invention, examples of which are illustrated in the accompanying drawings. Throughout the following detailed description, the same reference numerals refer to the same elements in all figures. Throughout this description, the term "boat" refers to any aquatic vehicle of any size or type including, but not limited to, boats, yachts, pleasure craft, etc. The term "dingy" refers to any secondary aquatic vehicle that is carried or towed by the boat including, but not limited to, jet skis, kayaks, canoes, a dingy, rafts, pontoon boats, etc. Throughout this description, the term "retracted position" refers to a condition in which the swim platform is substantially level with a deck of the boat and "deployed position" refers to a condition in which the swim platform is at a level lower than the deck of the boat, preferably below the surface of a body of water in which the boat is floating.

Figure 2:
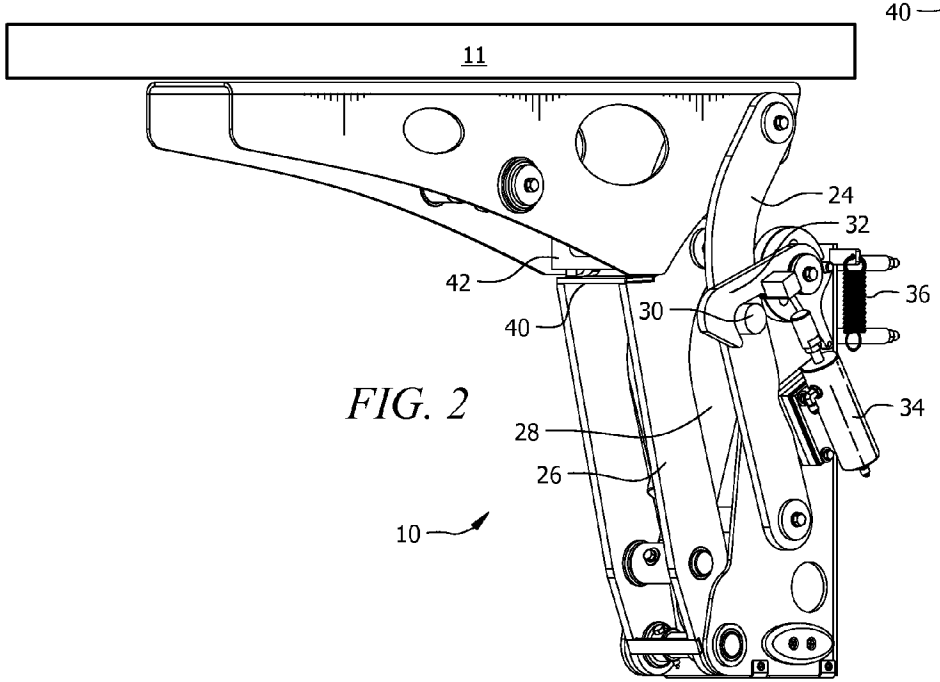
FIG. 2 illustrates a swim platform and mechanism for deploying a watercraft that is held by the swim platform in a raised position.
Figure 3:
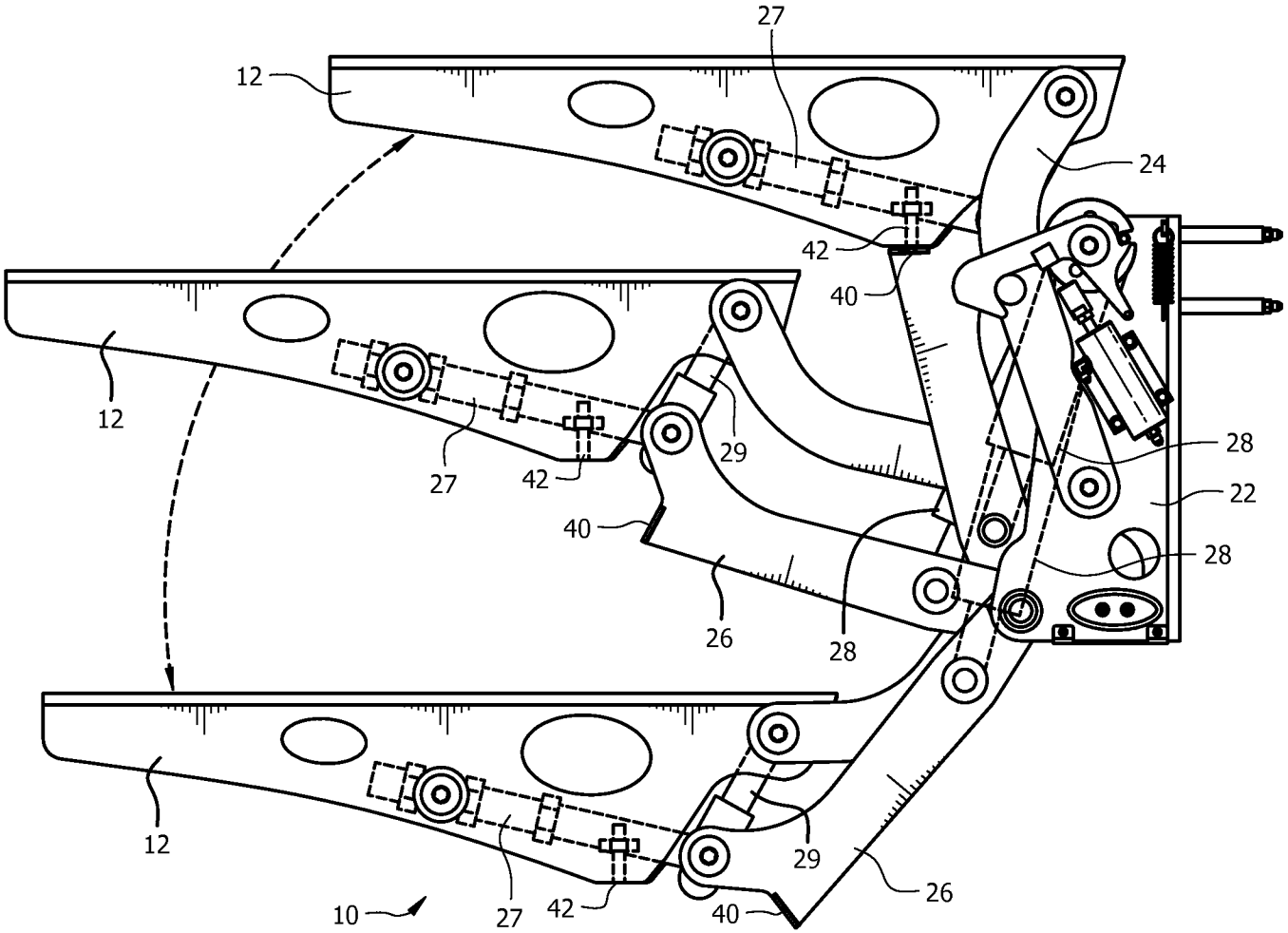
FIG. 3 illustrates the mechanism for deploying a watercraft transitioning between a lowered position to a raised position.

Referring to FIGS. 1, 2 and 3, a swim platform 11 and mechanism for deploying 10 a dingy 7 (see FIG. 4) that is held on the swim platform 11 will be described. In FIG. 1, the swim platform 11 is in the lowered position, preferably situated far enough below the surface of the surrounding body of water as to let the dingy 7 float, allowing the dingy 7 to be deployed from and/or returned to the swim platform 11. Note, in some embodiments, the dingy 7 is held in place on the swim platform 11 by chocks or a frame 14 (see FIG. 4).

In FIG. 2, the swim platform 11 is in the raised position, preferably situated level with the deck 4 of the boat 5 (see FIG. 4).

The mechanism for deploying 10 the dingy 7 includes two hinged arms 24/26 that keep the swim platform 11 in line with the deck 4 of the boat 5. This is to say that, when the swim platform 11 abuts the deck 4 of the boat 5, both are in substantially the same plane, and when the swim platform 11 is lowered the plane of the swim platform 11 is substantially parallel to the plane of the deck 4. A first end of a lower hinged arm 26 is hingedly attached to a lower section of a transom bracket 22 and a distal end of the lower hinged arm 26 is hingedly attached to a lower attach point of a swim platform interface bracket 12. Similarly, a first end of an upper hinged arm 26 is hingedly attached to a mid-section of a transom bracket 22 and a distal end of the upper hinged arm 26 is hingedly attached to an upper attach point of a swim platform interface bracket 12. The transom bracket 22 is affixed to the transom 3 of the boat 5 (see FIG. 4) and the swim platform interface bracket 12 is affixed to the swim platform 11 as known in the industry.

Although a single mechanism for deploying the dingy 7 is shown, any number of mechanisms 10 are anticipated, working side-by-side in parallel. For many boats, at least two mechanisms 10 are used, providing structural strength to support the swim platform 11 and increase side-to-side stability.

The swim platform 11 is deployed and retrieved by one or more hydraulic rams 28, as known in the industry. The hydraulic rams 28 are supplied with a controlled source of hydraulic pressure to extend or retract. One end of the hydraulic ram(s) 28 is affixed to the swim platform interface bracket 12 and the other end of the hydraulic ram(s) 28 is affixed to the transom bracket 22.

For completeness, a hydraulic locking mechanism is shown. The hydraulic locking mechanism includes a catch 32 that engages with a peg 30 when the swim platform 11 is in the retracted position (as shown in FIG. 2). Just before deploying the swim platform 11, the cylinder 34 is pressurized to pull (or push) the catch 32 away from the peg 30 to release the swim platform 11. The catch 32 is biased towards the peg 30 by a spring 36 and the force of the spring 36 is overcome by the cylinder 34 to release the catch 32. The catch 32 maintains the retracted position of the swim platform 11, especially during boating wherein the constant motion of the boat 5 over waves would otherwise constantly apply back pressure against the hydraulic ram and either requires constant fluid pressure or near-perfect seals to maintain the retracted position. Any type of locking mechanism is anticipated, including, but not limited to hydraulic locking mechanisms, solenoid locking systems, and manually released locking mechanisms.

Once the swim platform 11 reaches the retracted position as shown in FIG. 2, it is desired that the swim platform 11 feel sturdy and secure as it is often stood on by boaters when boarding, swimming, etc. Due to the manner in which the forces act on the dual-point arm system 24/26, when stepping onto or off of the swim platform 11, the weight of the boater results in up/down movement of the swim platform 11. This is often disconcerting to the boater who is used to a sturdy deck and swim platform surface because boats of the prior art had fixed swim platforms 11. To provide the desired sturdiness, the lower arm 26 has a rest area 40. As the swim platform is retracted, rest area 40 contacts an adjustable stop 42, providing a sturdy resting point at a greater distance from the transom 3 of the boat 5. The adjustable stop 42 is threaded so that turning of the adjustable stop 42 moves the adjustable stop inwardly (outwardly) with respect to the swim platform interface bracket 12. By turning the adjustable stop 42, the retracted position of the swim platform 11 is adjusted slightly to adjust the retracted position of the swim platform 11 with respect to the deck 4 of the boat 5.

When in a retracted position, as in FIG. 2, the weight of the swim platform 11, swimmer and or dingy 7 wants to push the platform 11 down and toward the water. Without the rest area 40 and adjustable stop 42, the resulting force had to be withstood by the hydraulic ram 28, and or the catch 32. Due to those constraints the force acts through the strut 27 which connects between to the top portion of the lower arm 26 and the swim platform interface bracket 12, in conjunction with a third-point arm 29. With the lower arm 26 loaded and restrained in this fashion it represents a classical overhanging beam with two simple supports and a load at its end. Deflection of this type of beam is significantly related to the overhung length, in this case the distance between where the strut 27 and ram 28 connect to the lower arm 26. This deflection is directly related to the deflection of the swim platform 11.

The design shown improves on the prior art with the addition of the rest area 40 and the adjustable stop 42. The contact between the rest area 40 and adjustable stop 42 changes the load path due to the weight of the swim platform 11, swimmer and or dingy 7. The reaction through the strut 27 is now negligible due to the reaction taking place on the rest area 40 by the adjustable stop 42. The lower arm 26 is now loaded in a manner which reflects a classical axial loaded column. This type of structure has minimal deflection compared to an overhung beam with geometry held constant. The minimal deflection of the lower arm 26 due to the contact between the rest area 40 and adjustable stop 42 allows for nominal movement in the swim platform 11 providing the desired sturdy feel.

In FIG. 3, the mechanism 10 for deploying a watercraft transitioning the swim platform 11 between a deployed position to a retracted position is shown. As the hydraulic ram 28 is pressurized to contract, the swim platform interface bracket 12 is lifted until the rest area 40 of the lower arm 26 contacts the adjustable stop 42, at which point the swim platform interface bracket 12 is in the retracted position and is locked in place by the catch 32. This three-point structure provides improved stiffness to a swim platform 11 that is attached to the swim platform interface bracket 12 while also enabling minor adjustments to the retracted position of the swim platform 11 to eliminated potential tripping issues caused by an edge of the swim platform 11 not being flush with an upper edge of the deck 4 of the boat 5. FIG. 4B shows the edge of the swim platform 11 flush with the upper edge of the deck 4 of the boat 5 as obtained by proper adjustment of the adjustable stop 42.

Figure 4A:
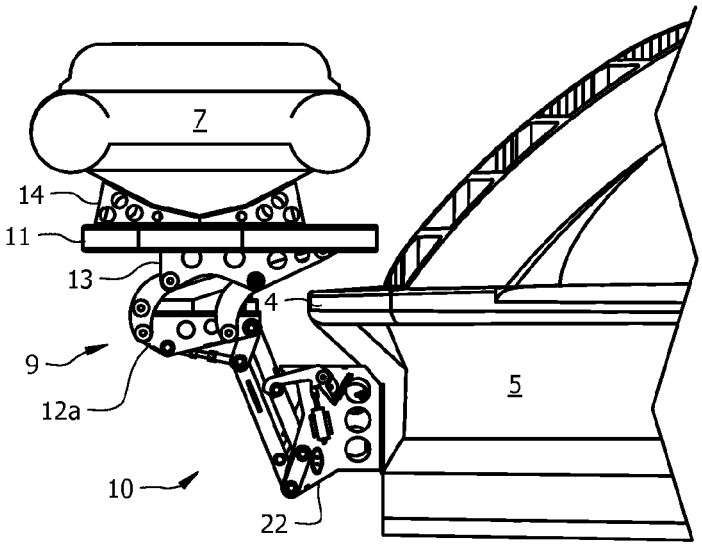
FIG. 4A illustrates a first view of a swim platform holding a watercraft, the mechanism for deploying a watercraft and a mechanism for raising the water craft up and over the boat deck, the swim platform being in the up-and-over position.
Figure 4B:
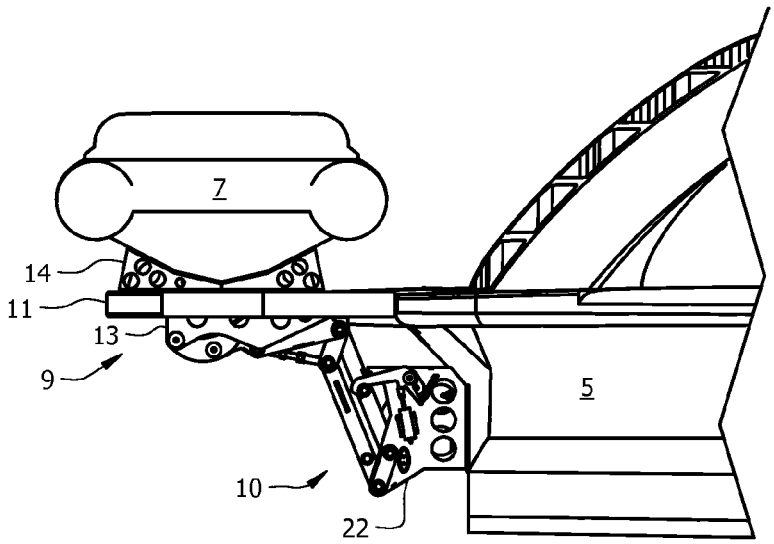
FIG. 4B illustrates a second view of a swim platform holding a watercraft, the mechanism for deploying a watercraft and a mechanism for raising the water craft up and over the boat deck, the swim platform being even with the deck of the boat.
Figure 4C:
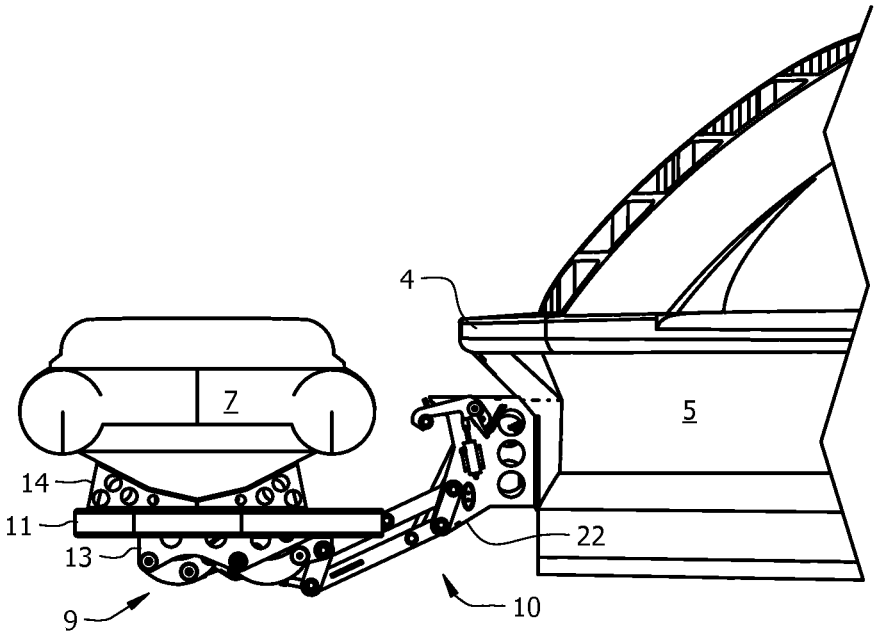
FIG. 4C illustrates a third view of a swim platform holding a watercraft, the mechanism for deploying a watercraft and a mechanism for raising the water craft up and over the boat deck, the swim platform being lowered into the water.

Referring to FIGS. 4A through 4C, transitional views of an up-and-over swim platform 11 holding a watercraft, the mechanism 10 for deploying a watercraft 7 and a mechanism for raising 9 the dingy 7 over the boat deck will be described. As shown in FIG. 4A, the dingy 7 is positioned up (higher than the deck 4 of the boat 5) and over (moved towards the bow of the boat 5, thereby overlapping the back section of the deck 4). There are several advantages to positioning the swim platform 11 and dingy 7 in this position. First, especially in rough seas, the dingy 7 is further removed from the water surrounding the boat 5 and, therefore, has less of a chance of dragging in the water. Second, because the dingy 7 and swim platform are lifted and moved forward (towards the bow), the center of gravity of the boat 5 is less affected by the weight of the swim platform 11 and of the dingy 7. This is especially important in boats 5 that need to come up on plane in order to achieve better fuel efficiency, more comfortable rides and higher speeds. Many pleasure craft operate at a certain angle with respect to the water when at very low speeds and at cruising speed or higher. Operating at a speed between the two speeds is often uncomfortable because of the angle of the boat's 5 deck 4, and results in the inefficient consumption of fuel because the propeller is busy pushing the hull of the boat 5 into the water instead of sliding the hull across the top of the water. When additional weight is added to the stern area of the boat 5, even higher speeds are required to achieve plane because the center of gravity moves farther towards the stern of the boat 5. Since the shift in the center of gravity is related to the weight of the dingy 7 times the distance of the dingy from the bow of the boat 5, the closer the weight of the dingy 7 is to the bow, the less effect the weight of the dingy 7 will have on the center of gravity.

Therefore, the up-and-over mechanism 9 continues the upward movement of the mechanism 10 for deploying a watercraft 7 while also moving the swim platform 11 and hence the dingy 7 towards the bow of the boat 5, thereby moving the center of gravity of the boat 5 closer to the bow of the boat 5. Throughout the travel of the swim platform 11, the swim platform preferably remains substantially within parallel planes to the plane of the deck 4. As shown in FIG. 4B, the up-and-over mechanism 9 is retracted and the swim platform 11 is level with the deck 4 of the boat 5.

Following through with FIG. 4C, the mechanism 10 for deploying a watercraft 7 is fully deployed and the dingy 7 is lowered into the water surrounding the boat 5.

Figure 5:
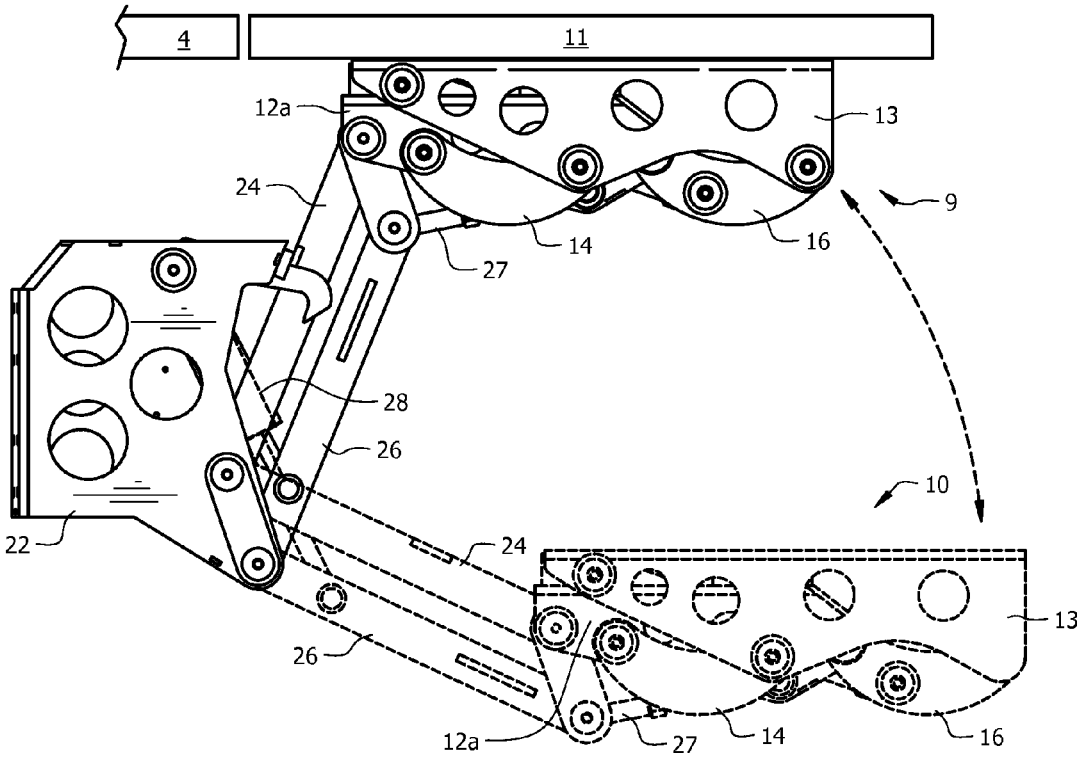
FIG. 5 illustrates a detail view of a swim platform, the mechanism for deploying a watercraft and a mechanism for raising the water craft up and over the boat deck, moving from a deployed position (in the water) to the swim platform even with the deck of the boat.
Figure 6:
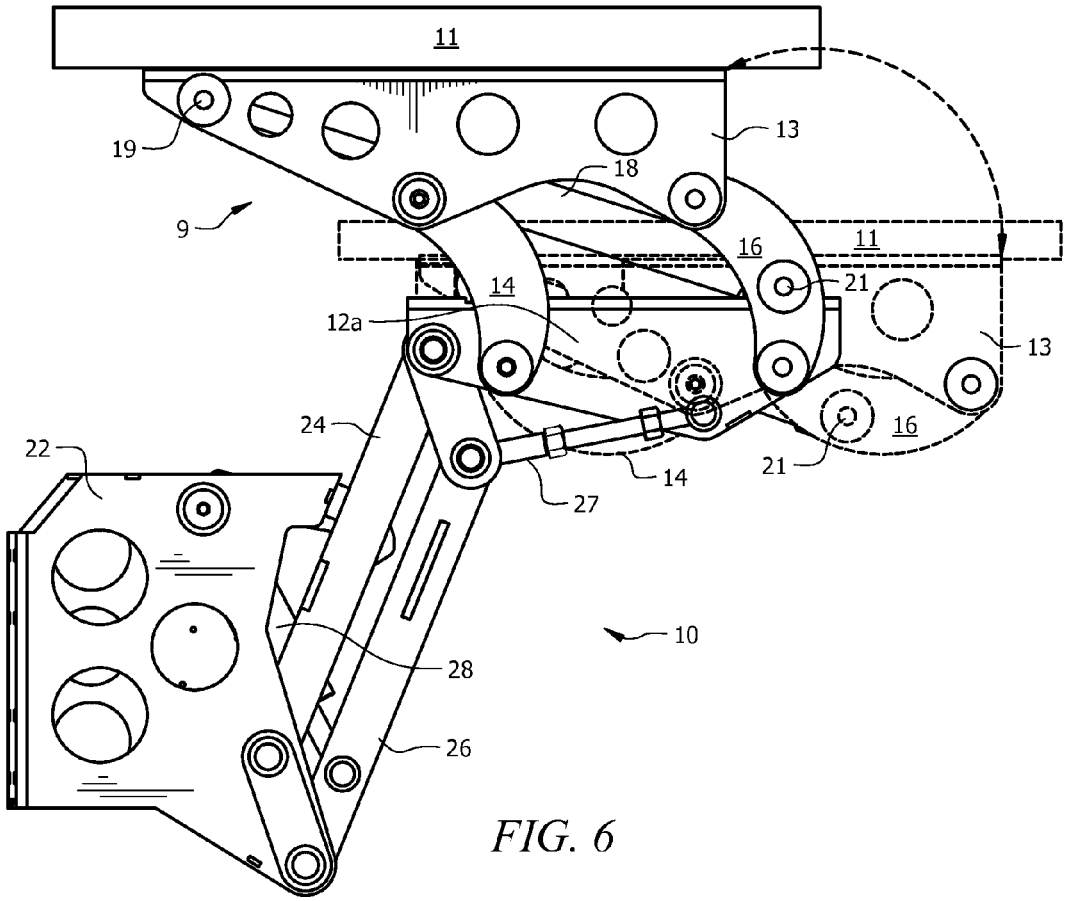
FIG. 6 illustrates a detail view of a swim platform, the mechanism for deploying a watercraft and a mechanism for raising the water craft up and over the boat deck, with the swim platform in an extended position (up and over the deck of the boat).

Referring to FIGS. 5 and 6, a detail view of a swim platform 11, the mechanism 10 for deploying the dingy 7 and a mechanism 9 for raising the water craft up and over the boat deck 4 is shown. In FIG. 5, the swim platform 11 is shown moving from a deployed position (in the water) to where the swim platform is even with the deck 4 of the boat 5. In FIG. 6 the swim platform 11 continues to move up and over the deck 4.

The operation of the mechanism 10 for deploying the dingy 7 is as described with FIGS. 1-3, except that the mechanism 9 for raising the water craft up and over the deck 4 is interfaced to the mechanism 10 for deploying the dingy 7 instead of the swim platform 11 and, consequently, the swim platform 11 is interfaced to the mechanism 9 for raising the water craft up and over the boat deck 4.

In this example, there are two frames 12A/13 interfacing to the swim platform which is part of the mechanism 9 for raising the water craft up and over the boat deck 4. A first, upper frame 13 interfaces to and attaches to the swim platform 11. A second, lower frame 12*a* interfaces and hingedly attaches to the arms 24/26 of the mechanism for deploying the dingy 7. The lower frame 12*a* is connected to the upper frame 13 by two or more arms 14/16 and a second hydraulic ram (see FIGS. 6 and 8). The Ram extends the upper frame 13 from a first position even with the boat deck 4 to a position that is up and over the boat deck 4. One end of the ram 18 is interfaced to the upper frame 13 by a cross member 19 as known in the industry while the distal end of the ram 18 is interfaced to either the lower frame 12*a* (not shown) or a cross member 21 connected to arms 16. In FIG. 5, up-and-over mechanism 9 is retracted and the swim platform 11 is level with the deck 4. In FIG. 6, the swim platform 11 is lifted up and over the edge of the deck 4 to move the center of gravity forward towards the bow of the boat 5. The hydraulic ram 18 pushes the upper frame 13 up and over the lower frame 12*a* as will be described with FIGS. 7A-7D. The arms 14/16 cause the connection points on the upper frame 13 to move in an arc having a radius centered on the connection points of the lower frame 12*a*. Since the arc is biased in its travel, the beginning of travel from the lowered position (even with the deck 4) to the up and over position (above and forward of the deck 4), the initial direction of movement is upward and optionally rearward before the later direction of movement is upward and forward, thereby the forward edge of the swim platform 11 clears the rear edge of the deck 4. Without this arced movement, the edges would interfere with each other, preventing the forward movement of the swim platform 11. Although two arms 14/16 are shown, any number of arms 14/16 is anticipated. It is preferred to have at least two arms 14/16 to provide rigidity and to maintain parallel planes between the top surface of the deck 4 and the top surface of the swim platform 11.

In some embodiments, the strut 27 is provided to adjust the angle of the swim platform 11 to a position such that the plane in which the upper surface of the swim platform 11 resides is the same as or parallel to the plane in which the deck of the boat resides. Adjustments are made as known in the industry using, for example, threaded fasteners, etc.

Figure 7A:
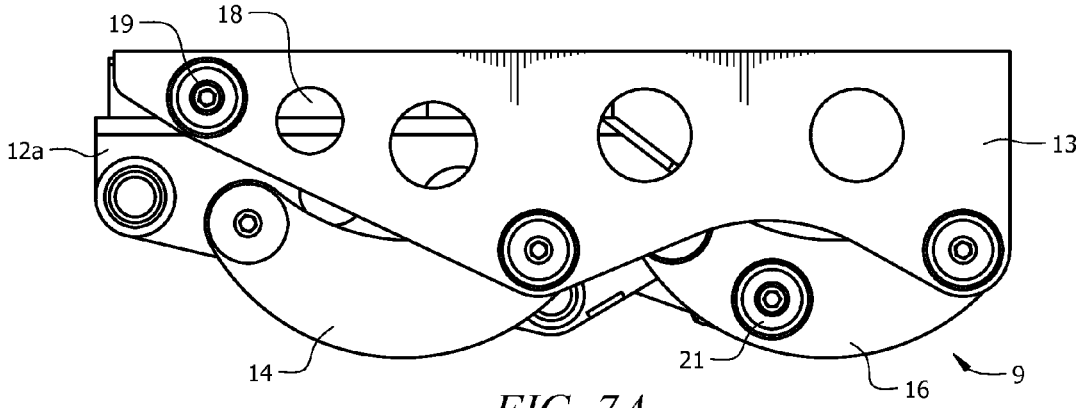
FIGS. 7A-7D illustrate a detail view of the mechanism for raising the water craft up and over the boat deck transitioning from a retracted position (level with the boat deck) to an extended position (up-and-over the deck).
Figure 7B:
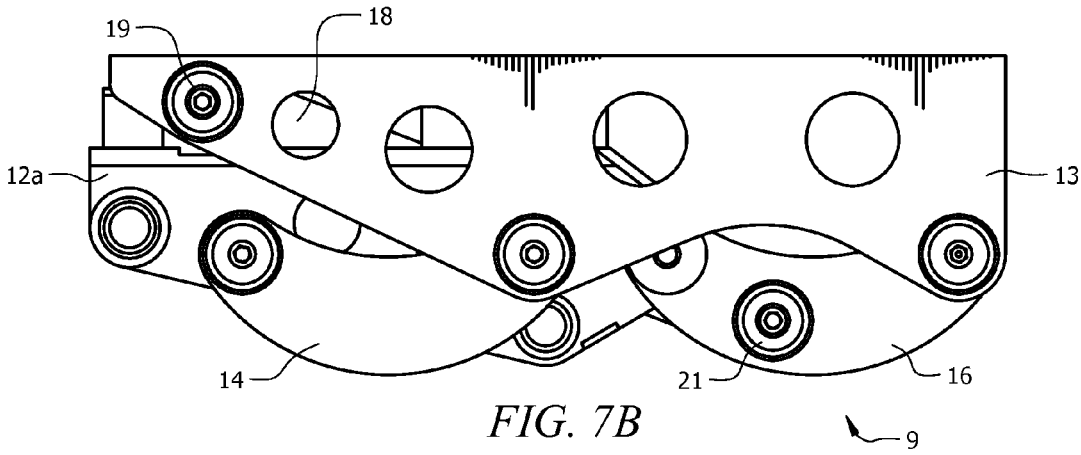
Figure 7C:
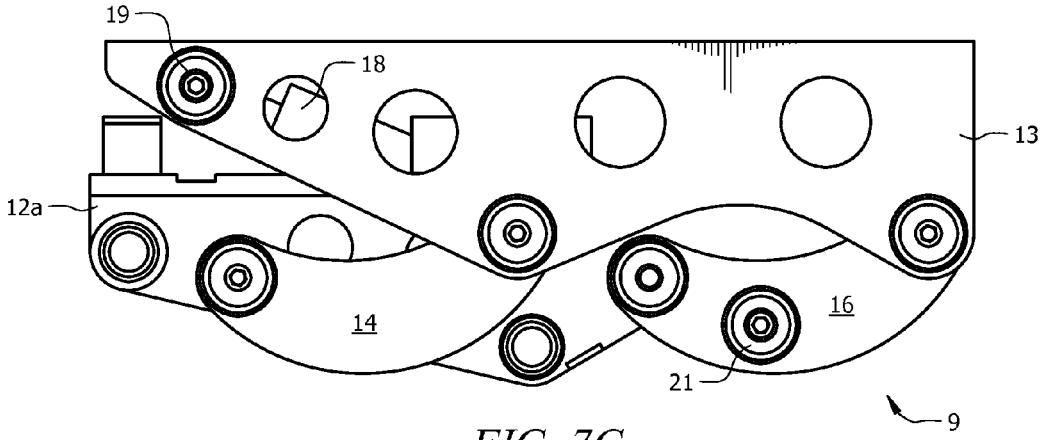
Figure 7D:
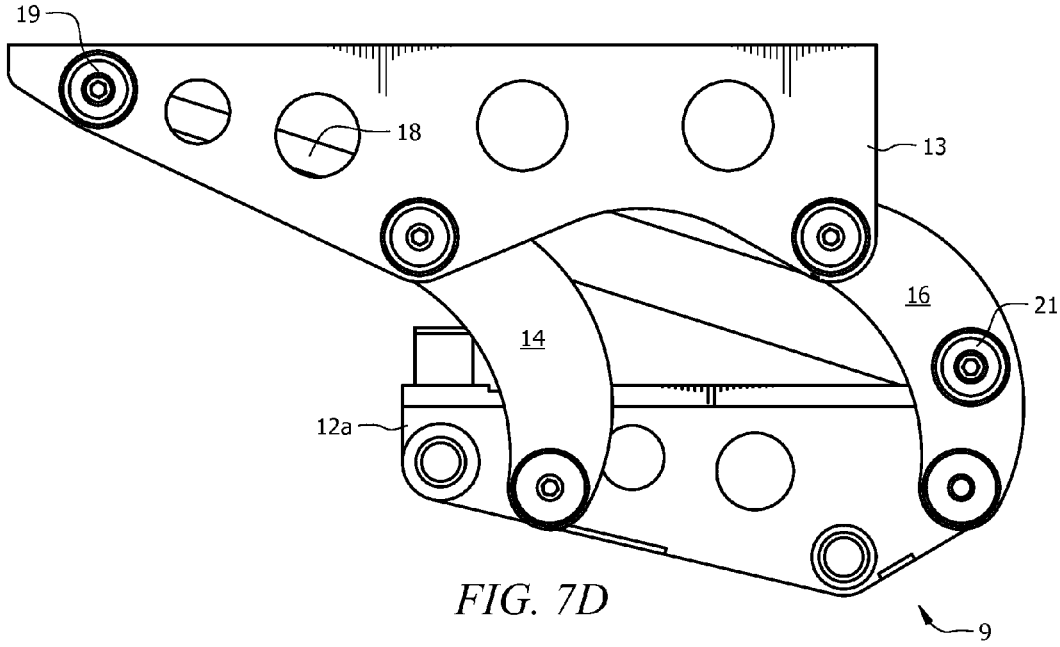
Figure 8:
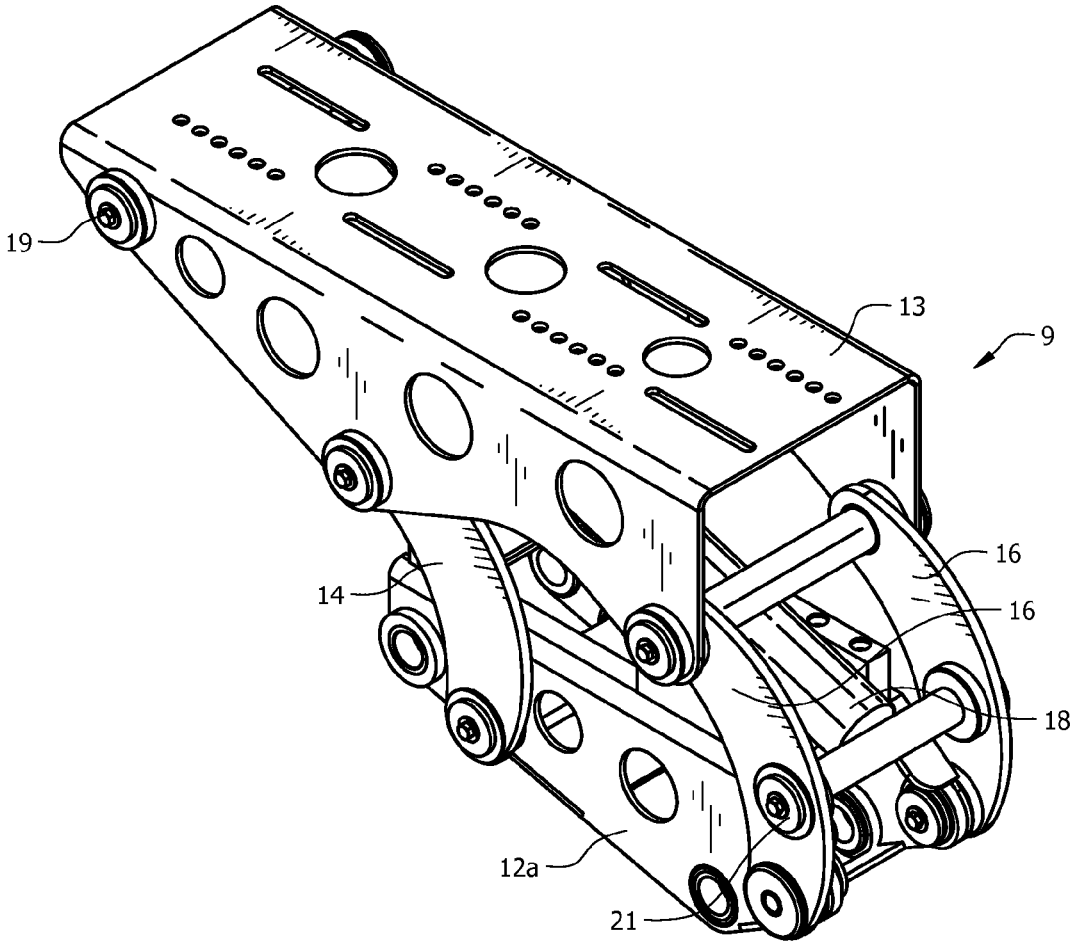
FIG. 8 illustrates a perspective view of the mechanism for raising the water craft up and over the boat deck in the extended position (up-and-over the deck).

Referring to FIGS. 7A-7D, detail views of the mechanism 9 for raising the water craft up and over the boat deck 4 transitioning from a retracted position (level with the boat deck) to an extended position (up-and-over the deck) will be described. In FIG. 7A, the upper frame 13 is in the retracted position (e.g. the swim platform is level with the boat deck). In this position, the back edge of the deck 4 aligns with the boat-side edge of the swim platform 11 as shown in FIG. 5. Because the edges are at approximate right angles to the surfaces of the deck 4 and swim platform 11 and because the edges are desired to be very close to each other, the swim platform must be first lifted so that the boat-side edge of the swim platform 11 clears the back edge of the deck 4 without rubbing. To provide the lift-first, move forward second motion, the arc members 14/16 are positioned such that the upper frame 13 moves on an arc with respect to the lower frame 12*a*, moving first in a slightly stern direction but predominately upward direction until the back edge of the deck 4 clears the boat-side edge of the swim platform 11 as in FIG. 7B, then, after the back edge of the deck 4 clears the boat-side edge of the swim platform 11, movement continues upward as in FIG. 7C and finally upward and forward as in FIG. 7D Referring to FIG. 8, a perspective view of the mechanism 9 for raising the dingy 7 up and over the boat deck 4 (up-and-over the deck) will be described. In this view, the base of the hydraulic ram 18 is visible and attached to a cross member 21 that is connected to the rear arc members 16. The front of the hydraulic ram 18 is connected to a forward mounted cross member 19 (partially hidden) that is connected to the upper frame 13.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. An up-and-over hydraulic lift system comprising:

a swim platform having a substantially planar top surface and a bottom surface;

a transom bracket, the transom bracket for attachment to a transom of a water vehicle, the transom bracket having an upper end and a lower end, the upper end of the transom bracket for mounting closest to a deck of the water vehicle;

an upper frame, the upper frame affixed to the bottom surface of the swim platform, the upper frame having a first end being closest to the transom bracket and a distal second end;

a lower frame, the lower frame having a first end being closest to the transom bracket and a distal second end;

an upper hinged arm, a first end of the upper hinged arm pivotally attached to the lower frame at the first end of the lower frame, a distal second end of the upper hinged arm pivotally attached to the transom bracket at a location of the transom bracket between the upper end of the transom bracket and the lower end of the transom bracket;

a lower hinged arm, a first end of the lower hinged arm pivotally interfaced to the lower frame at a location between the first end of the lower frame and the distal second end of the lower frame, a second end of the lower hinged arm pivotally attached to the lower end of the transom bracket;

a first hydraulic ram; a first end of the first hydraulic ram is pivotally connected to the lower hinged arm at a point on the lower hinged arm between a mid-point of the lower hinged arm and the second end of the lower hinged arm, a second end of the hydraulic ram is pivotally connected to the upper end of the transom bracket;

a first arm, a first end of the first arm pivotally connected to the upper frame between the first end of the upper frame and the distal second end of the upper frame, a second end of the first arm pivotally connected to the lower frame at the first end of the lower frame;

a second arm, a first end of the second arm pivotally connected to the upper frame at the distal rear end of the upper frame, a second end of the second arm pivotally connected to the lower frame at the distal second end of the lower frame; and a second hydraulic ram, a first end of the second hydraulic ram is pivotally connected to the first end of the upper frame, a second end of the second hydraulic ram is pivotally connected to the second arm;

whereas, as the swim platform is raised/lowered, a pitch of the substantially planar top surface of the swim platform remains substantially constant with respect to the transom bracket.

2. The up-and-over hydraulic lift system of claim 1, wherein the first arm and the second arm are arched.

3. A method of lifting a swim platform for a boat, the boat floating in a liquid, the method comprising:

attaching the up-and-over hydraulic lift system of claim 1 to a transom of the boat, the swim platform being substantially even with a deck of the boat;

lowering the swim platform by expanding the first hydraulic ram until the swim platform is below a surface of the liquid;

positioning a water craft upon the swim platform; and raising the swim platform by expanding the first hydraulic ram until the swim platform is substantially level with the deck of the boat.

4. The method of claim 3, further comprising:

raising the swim platform by expanding the second hydraulic ram, the swim platform moving in an upward direction until at least a forward edge of the swim platform clears a rear edge of the deck of the boat, then the swim platform moving further in the upward direction and a direction toward the boat such that the swim platform overlaps a portion of the deck.

5. The method of claim 4, further comprising:

lowering the swim platform by contracting the second hydraulic ram, the swim platform moving in an downward direction and in a direction away from the boat until at least the forward edge of the swim platform clears the rear edge of the deck, then the swim platform moving further in the downward direction until the swim platform is even with the deck.

6. An up-and-over hydraulic lift system comprising:

a swim platform having a substantially planar top surface and a bottom surface;

a transom bracket, the transom bracket for attachment to a transom of a water vehicle, the transom bracket having an upper end and a lower end, the upper end of the transom bracket for mounting closest to a deck of the water vehicle;

an upper frame, the upper frame affixed to the bottom surface of the swim platform, the upper frame having a first end being closest to the transom bracket and a distal second end;

a lower frame, the lower frame having a first end being closest to the transom bracket and a distal second end;

an upper hinged arm, a first end of the upper hinged arm pivotally attached to the lower frame at the first end of the lower frame, a distal second end of the upper hinged arm pivotally attached to the transom bracket at a location of the transom bracket between the upper end of the transom bracket and the lower end of the transom bracket;

a lower hinged arm, a first end of the lower hinged arm pivotally attached to the lower frame at a location between the first end of the lower frame and the distal second end of the lower frame, a second end of the lower hinged arm pivotally attached to the lower end of the transom bracket;

means for raising/lowering the lower frame with respect to the transom bracket, the means for raising/lowering the lower frame interfaced between the transom bracket and the lower frame;

a first arm, a first end of the first arm pivotally connected to the upper frame between the first end of the upper frame and the distal second end of the upper frame, a second end of the first arm pivotally connected to the lower frame at the first end of the lower frame;

a second arm, a first end of the second arm pivotally connected to the upper frame at the distal second end of the upper frame, a second end of the second arm pivotally connected to the lower frame at the distal second end of the lower frame; and means for raising/lowering the upper frame with respect to the lower frame, the means for raising/lowering the upper frame interfaced between the upper frame and the lower frame;

whereas, as the swim platform is raised/lowered, a pitch of the substantially planar top surface of the swim platform remains substantially constant with respect to the transom bracket.

7. The up-and-over hydraulic lift system of claim 6, wherein the first arm and the second arm are arched.

8. The up-and-over hydraulic lift system of claim 6, wherein the means for raising/lowering the lower frame is a first ram.

9. The up-and-over hydraulic lift system of claim 6, wherein the means for raising/lowering the upper frame is a second ram.

* * * * *